US008511132B2

(12) United States Patent
Burgstaller et al.

(10) Patent No.: US 8,511,132 B2
(45) Date of Patent: Aug. 20, 2013

(54) BENDING PRESS HAVING SUPPORT BEARING DEVICE FOR DRIVE MEANS

(75) Inventors: Rainer Burgstaller, Voecklabruck (AT); Egon Danninger, Leonding (AT)

(73) Assignee: TRUMPF Maschinen Austria GmbH & Co. KG., Pasching (AT)

( * ) Notice: Subject to any disclaimer, the term of this patent is extended or adjusted under 35 U.S.C. 154(b) by 130 days.

(21) Appl. No.: 12/998,403

(22) PCT Filed: Oct. 12, 2009

(86) PCT No.: PCT/AT2009/000397

§ 371 (c)(1),
(2), (4) Date: Jun. 29, 2011

(87) PCT Pub. No.: WO2010/042962

PCT Pub. Date: Apr. 22, 2010

(65) Prior Publication Data

US 2011/0252859 A1 Oct. 20, 2011

(30) Foreign Application Priority Data

Oct. 15, 2008 (AT) ..... A 1611/2008

(51) Int. Cl.
*B21D 5/02* (2006.01)

(52) U.S. Cl.
USPC ..... 72/389.3; 72/389.4; 72/389.5; 72/701

(58) Field of Classification Search
USPC ..... 72/389.3, 389.4, 389.5, 455, 701
See application file for complete search history.

(56) References Cited

U.S. PATENT DOCUMENTS

| | | | | |
|---|---|---|---|---|
| 4,016,742 | A * | 4/1977 | Shiokawa | 72/389.5 |
| 4,580,434 | A * | 4/1986 | Graf | 72/389.5 |
| 5,293,972 | A | 3/1994 | Krumholz | |
| 6,374,658 | B1 | 4/2002 | Gascoin et al. | |
| 6,401,512 | B1 | 6/2002 | Gascoin | |
| 8,245,557 | B2 * | 8/2012 | Jacquet et al. | 72/386 |

FOREIGN PATENT DOCUMENTS

| | | |
|---|---|---|
| DE | 91 16 894 | 10/1994 |
| DE | 600 05 763 | 8/2004 |
| EP | 0 543 772 | 5/1993 |
| GB | 640 253 | 7/1950 |
| JP | 2000-343125 | 12/2000 |
| JP | 2001-121214 | 5/2001 |
| NL | 1 029 177 | 12/2006 |
| WO | WO 00/13813 | 3/2000 |
| WO | WO 01/43896 | 6/2001 |

OTHER PUBLICATIONS

International Search Report of PCT/AT2009/000397, Apr. 8, 2010.

* cited by examiner

*Primary Examiner* — David B Jones
(74) *Attorney, Agent, or Firm* — Collard & Roe, P.C.

(57) ABSTRACT

The invention relates to a bending press (1), in particular a press brake (2), for producing workpieces (3) by bending between a bench beam (11) equipped with at least one bending tool (4) disposed in a stationary arrangement on a machine frame (5) and a pressing beam (14) equipped with at least one bending tool (4) which can be displaced relative to the bench beam (11) in linear guides (13) of the machine frame (5) by means of at least one drive means (19) secured to a support bearing device (25). The support bearing device (25) is provided in the form of at least one mounting plate for at least one drive means (19). The latter constitutes a mounting ring for the drive means (19), some regions of which are provided with orifices or peripheral recesses surrounding the mounting ring and weakened zones (38) are provided in the pressing beam (14).

16 Claims, 3 Drawing Sheets

BENDING PRESS HAVING SUPPORT BEARING DEVICE FOR DRIVE MEANS

CROSS REFERENCE TO RELATED APPLICATIONS

This application is the National Stage of PCT/AT2009/000397 filed on Oct. 12, 2009 which claims priority under 35 U.S.C. §119 of Austrian Application No. A 1611/2008 filed on Oct. 15, 2008, the disclosure of which is incorporated by reference. The international application under PCT article 21(2) was not published in English.

The invention relates to a bending press.

Document WO 2000/13813 A1 discloses a bending press with a table beam and a pressing beam which can be displaced relative to it, and the table beam has V-shaped cut-outs extending from opposing side faces across a part region of a half of the bench beam length which act as weakened zones, thereby resulting in resiliently elastic, protruding bench regions. The cut-outs are bridged by adjustable adjusting means which are supported in the foot region of the table beam and a regulating element is drivingly connected to the protruding region of the table beam. This enables a support surface of the table beam for the bending tool to curve forwards in an arcuate shape across a length of the table beam in order to compensate for the flexing which occurs during the forming process due to compressive load.

Another document, EP 0 543 772 A1, discloses a two-part top beam of a bending press and a freely lying bottom beam. The top beam is split approximately in two in the direction of force and the two beam parts sit in contact with one another at the beam center and are separated from one another on either side of the contact point by a gap which becomes wider in the direction of the peripheral regions in each case. The force transmitted by the drives for the displaceable top beam is transmitted to the top beam part. Due to the fact that the top beam is sub-divided, uniform flexing is obtained when a forming force is applied and the bending lines of the top beam and the bottom beam are more or less compensated.

The objective of the invention is to propose a bending press by means of which the deformation of the machine frame which occurs under the effect of force does not essentially affect the forming accuracy and the drive system. This objective is achieved by means of the features defined in according to the invention. The surprising advantage obtained as a result is that the mounting ring supporting the drive means by a top face is supported in a resiliently elastic manner with respect to the region where the press frame is mounted, which means that, irrespective of its deformation, the drive means can be oriented to prevent transversely directed forces.

Also of advantage are other embodiments because a universal mounting can be obtained very effectively for the drive means and a plane formed by a surface of the mounting ring deflects relative to a mounting plane of the mounting plate on the press frame in a resiliently elastic region.

As a result of other advantageous embodiments, the support bearing device may be used for presses with both one and more than one drive means, thereby guaranteeing an independent, resiliently elastic compensating movement to compensate for deformation.

Other advantageous embodiments ensure that force is transmitted to the drive means free of strain irrespective of the bending deformation of the pressing beam which occurs under load during the bending process.

Also of advantage are other embodiments, whereby weakened zones in the pressing beam can be disposed so that they can be adapted to suit possible applications.

Finally, however, another embodiment is also of advantage because a deformation region of the pressing beam can be regulated accordingly to suit specific application parameters.

To provide a clearer understanding, the invention will be described in more detail below with reference to the appended drawings.

The invention will be explained on the basis of examples of embodiments illustrated in the drawings.

These are highly schematic, simplified diagrams illustrating the following:

Figures 1, 2:
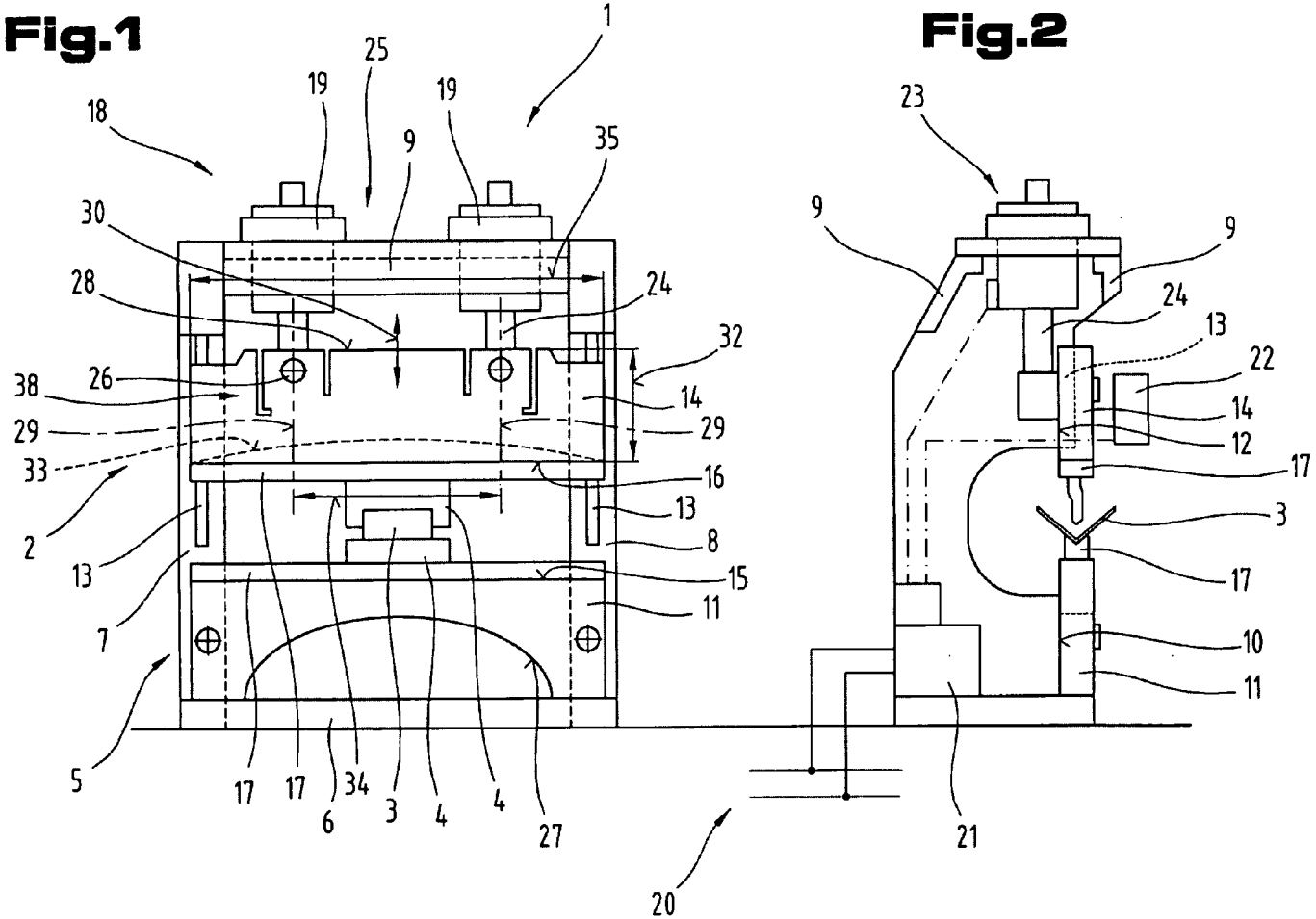
FIG. 1 is a front view of the bending press proposed by the invention.
FIG. 2 is a side view of the bending press.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc., relate to the drawing specifically being described and can be transposed in terms of meaning to a new position when another position is being described. Individual features or combinations of features from the different embodiments illustrated and described may be construed as independent inventive solutions or solutions proposed by the invention in their own right.

All the figures relating to ranges of values in the description should be construed as meaning that they include any and all part-ranges, in which case, for example, the range of 1 to 10 should be understood as including all part-ranges starting from the lower limit of 1 to the upper limit of 10, i.e. all part-ranges starting with a lower limit of 1 or more and ending with an upper limit of 10 or less, e.g. 1 to 1.7, or 3.2 to 8.1 or 5.5 to 10.

FIGS. 1 and 2 illustrate a bending press 1, in particular a press brake 2, for producing workpieces 3 between bending tools 4 which can be adjusted relative to one another.

A machine frame 5 of the bending press 1 comprises a bed plate 6 on which vertically extending, mutually spaced apart side panels 7, 8 are disposed, oriented parallel with one another. The latter are preferably connected at their end regions spaced apart from the bed plate by means of a solid transverse member 9 of sheet metal, for example.

The side panels 7, 8 are approximately C-shaped so as to provide a space for forming the workpiece 3, and a stationary bench beam 11 is secured to front faces 10 of legs of the side panels 8 standing on the bed plate 7 close to the ground. A pressing beam 14 which can be displaced relative to the bench beam 11 is mounted on end faces 12 of legs spaced apart from the ground in linear guides 1. Tool holders 17 are disposed on mutually opposite faces 15, 16 of the bench beam 11 and pressing beam 14 for setting up the bending tool 4.

The illustrated bending press 1 has a drive arrangement 18 for the displaceable pressing beam 14 in the form of two electrically operated drive means 19, which are hard-wired to a control system 21 powered from a power network 20. Operation of the bending press 1 is controlled from an input terminal 22 wired to the control system 21 for example.

It should be pointed out that the drive means 19 might be a cylinder operated by pressurizing medium or spindle drives 23 driven by electric motors, e.g. with a spindle nut in a housing driven in rotation and a threaded spindle connected to the pressing beam serving as an adjusting means. The spindle nut may be driven by means of a high-pole electric motor, e.g. a torque motor.

Adjusting means 24 for the drive means 19 are drivingly connected to the pressing beam 14 to enable it to effect a reversible actuating movement, and fixing means 26 such as bolts, for example, are provided in order to compensate for any deformation of the pressing beam 14 and of a support bearing device 25 for the drive means 19.

In the embodiment illustrated, the bench beam 11 has a bench recess 27 to provide space for the legs of a seated operator of the bending press 1 when mass producing small items, for example. However, this design is suitable for bending presses 1 with a lower pressing power due to the fact that the bench beam 11 has a reduced resistance to deformation.

To avoid making the description unnecessarily long, other aspects involved in operating a bending press 1 of this type, such as safety features, stop arrangements, control and measuring systems, will not be explained here.

As may also be seen from FIG. 1, weakened zones are provided in the pressing beam 14, extending approximately symmetrically with respect to a force transmission line 29 of the drive means 19 and parallel with the direction in which the pressing beam 14 is displaced—indicated by double arrow 30—for example slot-shaped cuts in the material, from a top face 28 across part of a height 32 of the pressing beam 14 in the direction of the tool holder 17.

The weakened zones on either side of the fixing means 26 securing the adjusting means 24 to the pressing beam 14 enable a deformation of the pressing beam 14 to be compensated, for example induced by a central load applied when forming the workpiece 3 between the bending tools 4 as indicated by a bending line 33 for the pressing beam 14 shown by broken lines.

The compensation is achieved by a springing action caused by the weakened zones and a gap 34 between the force transmission lines of the two drive means 19 predefined by the disposition of the drive means 19 is maintained as a result, thereby preventing any lateral loads from acting on the adjusting means 24.

These weakened zones also cause a counter-deformation of the bending line 33 at the mutually opposite end regions of the pressing beam 14 when a force is applied and distributed uniformly across an entire length 35 of the pressing beam 14, for example during a forming operation, thereby requiring fewer features to compensate for a bending angle on the workpiece 3.

Figure 3:
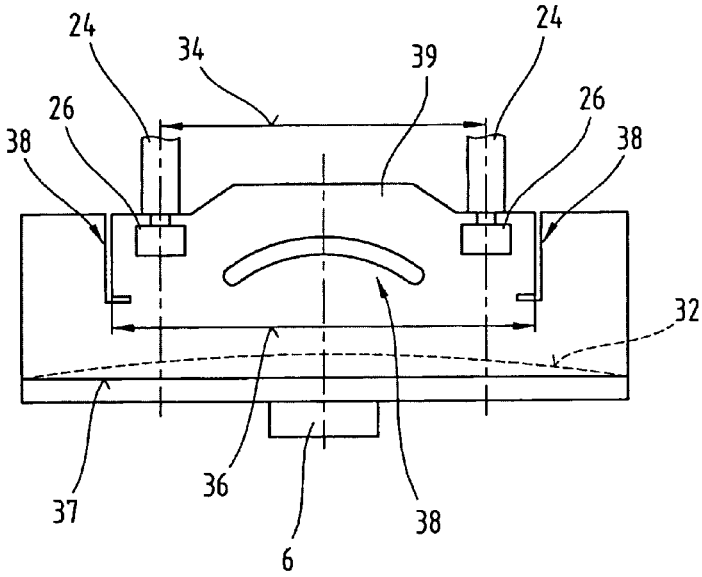
FIG. 3 is a front view of a pressing beam of the bending press.
Figure 4:
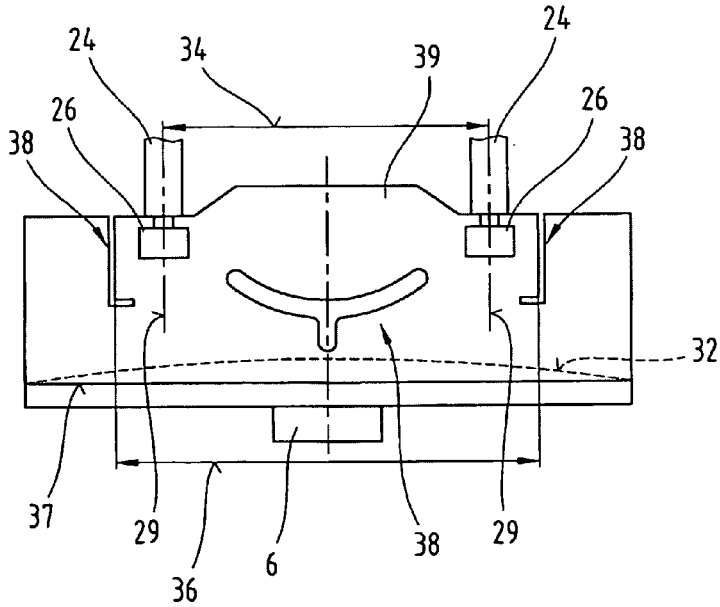
FIG. 4 shows a front view of another embodiment of the pressing beam.

FIGS. 3 and 4 illustrate different embodiments of the design used for the weakened zones in the pressing beam 14. In these instances, the vertically disposed cuts in the material are disposed at a greater distance 36 than that corresponding to the gap 34 between the force transmission lines 29. In the middle region of the pressing beam 14, weakened zones 38 are provided, which are curved in a concave or convex arrangement with respect to a face 37 used to support the bending tool 4 or extend in a straight line.

As a result, the pressing beam 14 is able to deform when subjected to a central load along the bending line 33, also indicated by broken lines, without affecting the gap 34, and this effect is achieved by means of a bridge 39 above the weakened zone 38 which remains between the linking regions of the fixing means 26 on the pressing beam 14.

The weakened zone 38 in the pressing beam 14 may be provided in the form of a slot, for example, or alternatively by a groove-shaped recess in the surface with a remaining wall web, etc. Another option is to provide an actuator bridging the weakened zones, for example a cylinder to which pressurizing medium can be applied, thereby enabling the degree of weakening to be regulated.

Figure 5:
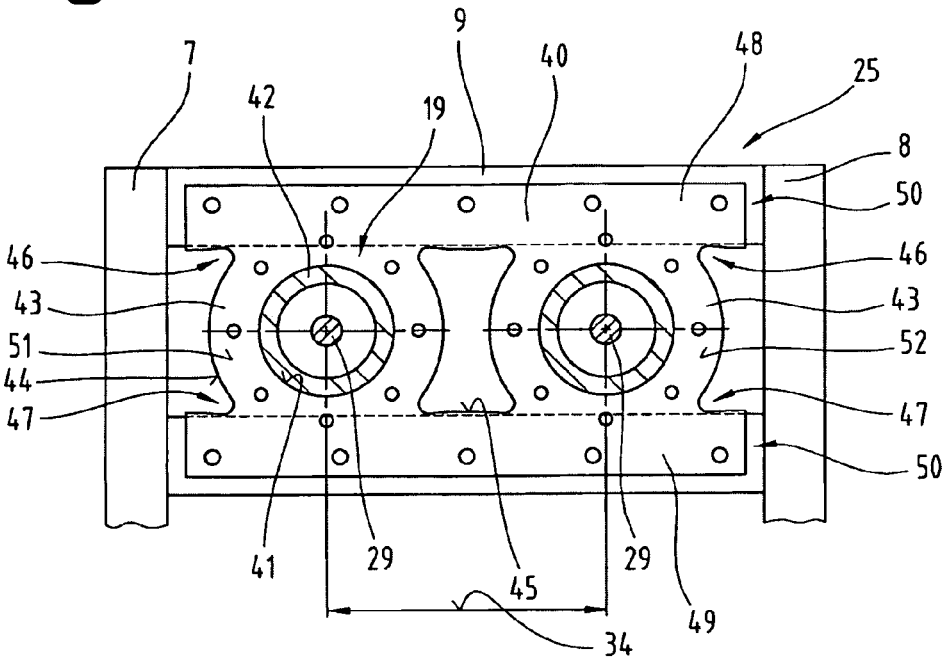
FIG. 5 shows a mounting plate for a drive arrangement of the bending press.

FIG. 5 is a detail illustrating one possible embodiment of the support bearing device 25 for a drive arrangement of the bending press with two of the drive means 19.

Secured to the transverse member 9 connecting the side panels 7, 8 is the support bearing device 25 provided in the form of a mounting plate 40.

The mounting plate 40 is provided with two bores 41 in the gap 34 between the drive means 19, through which a housing lug 42 and the adjusting means 24 of the drive means 19 extend. Surrounding the bores 41 are mounting rings 43 for mounting the drive means 19, for example by means of a flange, although this is not illustrated, which are connected to a mounting region provided in the form of peripheral strips 48, 49 by providing peripheral recesses 40 facing the side panels 8 and supporting webs 46, 47 formed by providing an orifice 45 in the middle between the bores 41. The mounting plate 40 is screwed to sections constituting the transverse member 9, for example.

By providing the supporting webs 46, 47, the peripheral recesses 44 and the orifice 45, weakened regions are formed in the connection of the mounting rings 43 to the peripheral strips 48, 49 which enable the plane containing the surfaces 51, 52 of the mounting rings 43 to pivot slightly, thereby independently counteracting a deformation of the machine frame occurring under load, ensuring that mid-axes of the drive means 19 and hence the force transmission lines 29 remain parallel. This ensures that, by reference to the drive means 19, force is transmitted centrally between the latter and the pressing beam 14, effectively preventing any lateral force from acting on the adjusting means 24 and bearing arrangement of the drive means 19.

Figure 6:
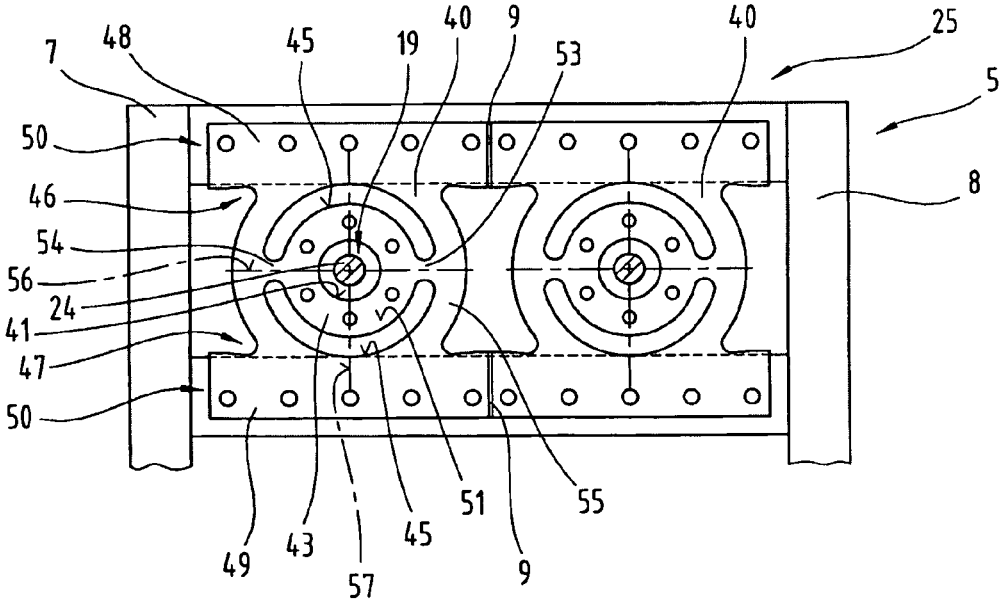
FIG. 6 shows a different embodiment of the mounting plate.

FIG. 6 illustrates another embodiment of the support bearing device 25 which, in the case of the embodiment illustrated as an example here, is based on a two-part design.

From here on, the description will be limited to one of the identically designed mounting plates 40, each of which is designed to accommodate one of the drive means 19 and each of which is secured separately to the transverse member 9 between the side panels 7, 8 of the machine frame 5.

The mounting plate 40 has the bore 41 through which the adjusting means 24 of the drive means 19 extends. Disposed concentrically with the bore 41 and spaced at a distance apart from it in the direction of the peripheral strips 48, 49 are orifices 45 extending in an arc-shaped arrangement, and the bore 41 is disposed surrounding the mounting ring 43, which is provided as a means of securing the drive means 19 to a flange, although the latter is not illustrated.

Apex points of the orifices 45 extending in an arc-shaped arrangement co-operate with the peripheral strips 48, 49, and oppositely lying end regions of the orifices 45 are spaced at a distance apart from one another, thereby creating two diametrically opposite connecting webs 53, 54 with an annular plate region 55, which is connected to the mounting region 50 formed by the peripheral strips 48, 49 via the supporting webs 46, 47 formed by the peripheral recesses 54 already described in connection with the previous drawings.

Due to the fact that the connecting webs 53, 54 are disposed in an arrangement offset from the supporting webs 46, 47 by 90° and because the weakened regions formed as a result are disposed about theoretical pivot axes 56, 57 offset by 90°, a plane extending along the surface 51 of the mounting ring 43 is able to pivot slightly about the pivot axis 56 and pivot axis 57 and hence compensate for any load-induced deformations of the machine frame 5 as described above in connection with the previous drawings in order to obtain a parallel orientation of the force transmission linen 29 regardless of the load situation and prevent transverse forces from acting on the adjusting means 24 and drive means 19.

The embodiments illustrated as examples represent possible variants of the bending press, and it should be pointed out at this stage that the invention is not specifically limited to the variants specifically illustrated, and instead the individual variants may be used in different combinations with one another and these possible variations lie within the reach of the person skilled in this technical field given the disclosed technical teaching. Accordingly, all conceivable variants which can be obtained by combining individual details of the variants described and illustrated are possible and fall within the scope of the invention.

For the sake of good order, finally, it should be pointed out that, in order to provide a clearer understanding of the structure of the bending press, it and its constituent parts are illustrated to a certain extent out of scale and/or on an enlarged scale and/or on a reduced scale.

The objective underlying the independent inventive solutions may be found in the description.

Above all, the individual embodiments of the subject matter illustrated in FIGS. 1, 2; 3; 4; 5; 6 constitute independent solutions proposed by the invention in their own right. The objectives and associated solutions proposed by the invention may be found in the detailed descriptions of these drawings.

| List of reference numbers | |
|---|---|
| 1 | Bending press |
| 2 | Press brake |
| 3 | Workpiece |
| 4 | Bending tool |
| 5 | Machine frame |
| 6 | Bed plate |
| 7 | Side panel |
| 8 | Side panel |
| 9 | Transverse member |
| 10 | End face |
| 11 | Bench beam |
| 12 | End face |
| 13 | Linear guide |
| 14 | Pressing beam |
| 15 | Face |
| 16 | Face |
| 17 | Tool holder |
| 18 | Drive arrangement |
| 19 | Drive means |
| 20 | Power network |
| 21 | Control system |
| 22 | Input terminal |
| 23 | Spindle drive |
| 24 | Adjusting means |
| 25 | Support bearing device |
| 26 | Fixing means |
| 27 | Bench recess |
| 28 | Top face |
| 29 | Force transmission line |
| 30 | Double arrow |
| 31 | Slot |
| 32 | Height |
| 33 | Bending line |
| 34 | Distance |
| 35 | Length |
| 36 | Distance |
| 37 | Face |
| 38 | Weakened zone |

-continued

| List of reference numbers | |
|---|---|
| 39 | Bridge |
| 40 | Mounting plate |
| 41 | Bore |
| 42 | Housing lug |
| 43 | Mounting ring |
| 44 | Peripheral recess |
| 45 | Orifice |
| 46 | Supporting web |
| 47 | Supporting web |
| 48 | Peripheral strip |
| 49 | Peripheral strip |
| 50 | Mounting region |
| 51 | Surface |
| 52 | Surface |
| 53 | Connecting web |
| 54 | Connecting web |
| 55 | Plate region |
| 56 | Pivot axis |
| 57 | Pivot axis |

The invention claimed is:

1. A bending press for producing a workpiece comprising:

a) a machine frame comprising linear guides;

b) a support bearing device;

c) at least one drive device secured to the support bearing device;

d) a bench beam equipped with a first bending tool disposed in a stationary arrangement on the machine frame; and e) a pressing beam equipped with weakened zones and a second bending tool displaceable relative to the bench beam in the linear guides of the machine frame via the at least one drive device;

wherein the support bearing device comprises at least one mounting plate;

wherein said at least one mounting plate comprises a mounting ring for the at least one drive device and orifices or peripheral recesses surrounding some regions of the mounting ring; and wherein the workpiece is bent between the bench beam and the pressing beam.

2. Bending press according to claim 1, wherein the mounting ring is connected via supporting webs spacing the orifices or peripheral recesses at a distance apart from one another to mounting regions of the mounting plate in the form of peripheral strips.

3. Bending press according to claim 2, wherein the supporting webs and/or connecting webs constitute pivot axes for a pivoting movement of the mounting ring.

4. Bending press according to claim 1, wherein the orifices are provided in the form of arc-shaped slots in the mounting plate which extend around a part-region of a circumference of the mounting ring.

5. Bending press according to claim 2, wherein the supporting webs lying diametrically opposite connect the mounting ring to the mounting regions of the mounting plate.

6. Bending press according to claim 3, wherein the pivot axis formed by the supporting webs extends in a direction perpendicular to a length of the pressing beam.

7. Bending press according to claim 3, wherein the pivot axis formed by the connecting webs extends in a direction parallel with a length of the pressing beam.

8. Bending press according to claim 1, wherein the mounting plate has more than one mounting ring.

9. Bending press according to claim 1, wherein the weakened zones are disposed in the pressing beam in the region of a fixing device to an adjusting device extending from a top face of the pressing beam in a direction of displacement of the pressing beam.

10. Bending press according to claim 9, wherein the weakened zones are disposed on either side of a force transmission line of the drive device.

11. Bending press according to claim 9, wherein at least one weakened zone curving convexly with respect to a face is disposed in the pressing beam across a part of a gap between the fixing device.

12. Bending press according to claim 11, wherein at least one weakened zone curving concavely with respect to the face is disposed in the pressing beam across a part of the gap between the fixing device.

13. Bending press according to claim 11, wherein at least one weakened zone extending parallel with the face is provided in the pressing beam across a part of the gap between the fixing device.

14. Bending press according to claim 1, wherein at least one weakened zone is provided in the form of slot-shaped cuts in the material.

15. Bending press according to claim 1, wherein at least one weakened zone is provided in the form of groove-shaped recesses in the pressing beam.

16. Bending press according to claim 1, wherein at least one weakened zone is disposed bridging at least one actuator on the pressing beam which can be regulated to adjust a degree of weakening.

* * * * *

UNITED STATES PATENT AND TRADEMARK OFFICE

CERTIFICATE OF CORRECTION

PATENT NO. : 8,511,132 B2
APPLICATION NO. : 12/998403
DATED : August 20, 2013
INVENTOR(S) : Burgstaller et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 205 days.

Signed and Sealed this
Fifteenth Day of September, 2015

Michelle K. Lee

Michelle K. Lee
*Director of the United States Patent and Trademark Office*